US006736594B2

(12) United States Patent
Irie et al.

(10) Patent No.: US 6,736,594 B2
(45) Date of Patent: May 18, 2004

(54) AXIAL-FLOW TYPE HYDRAULIC MACHINE

(75) Inventors: Kouichi Irie, Tsuchiura (JP); Tomoyoshi Okamura, Minori (JP); Yoshio Anzai, Chiyoda (JP); Junichi Kurokawa, Yokohama (JP)

(73) Assignees: Hitachi, Ltd., Tokyo (JP); Junichi Kurokawa, Yokohama (JP)

( * ) Notice: Subject to any disclaimer, the term of this patent is extended or adjusted under 35 U.S.C. 154(b) by 0 days.

(21) Appl. No.: 10/180,029

(22) Filed: Jun. 27, 2002

(65) Prior Publication Data

US 2003/0002982 A1 Jan. 2, 2003

(30) Foreign Application Priority Data

Jun. 29, 2001 (JP) ..... 2001-197663

(51) Int. Cl.[7] ..... F04D 29/40
(52) U.S. Cl. ..... 415/128; 415/173.1; 415/221
(58) Field of Search ..... 415/128, 173.1, 415/157, 158, 220, 221, 58.5, 914

(56) References Cited

U.S. PATENT DOCUMENTS

| | | | | |
|---|---|---|---|---|
| 4,212,585 A | | 7/1980 | Swarden et al. | |
| 5,137,419 A | | 8/1992 | Waterman | |
| 6,514,034 B2 | * | 2/2003 | Okamura et al. | 415/58.5 |
| 6,540,482 B2 | * | 4/2003 | Irie et al. | 415/221 |

FOREIGN PATENT DOCUMENTS

| | | |
|---|---|---|
| EP | 0040769 | 12/1981 |
| EP | 0754864 | 2/1997 |
| EP | 1101947 | 5/2001 |
| JP | 2000-303995 | 10/2000 |
| JP | 2001-082392 | 3/2001 |

OTHER PUBLICATIONS

Sankar L. Saha, et al., "Suppression of Performance Curve Instabli.ity of a Mixed Flow Pump by Use of J–Groove", Journal of Fluids Engineering, Transactions of the ASME, vol. 122, Sep. 2000, pp. 592–597.

* cited by examiner

*Primary Examiner*—Edward K. Look
*Assistant Examiner*—Dwayne J. White
(74) *Attorney, Agent, or Firm*—Antonelli, Terry, Stout & Kraus, LLP

(57) ABSTRACT

In an axial flow hydraulic machine, a plural number of grooves 5 are formed on an inner surface of a casing, directed into a pressure gradient direction, for connecting between an inlet side of an impeller 1 and an inside of blade residing region on the casing inner surface. With movement of movable members 6 provided on the casing inner surface, the grooves appear within the blade residing region in an unstable operation region, while the grooves cause no interference with the blades of the impeller in a stable operation region.

15 Claims, 13 Drawing Sheets

AXIAL-FLOW TYPE HYDRAULIC MACHINE

BACKGROUND OF THE INVENTION

The present invention relates to an axial-flow type hydraulic machine, having an impeller of non-voluminous type therein, and in particular, to the machine being able to avoid falling into instability in flow, by suppressing pre-swirl generating in main flow of re-circulating flow at an impeller blade inlet and stalls due to blade swirls, thereby being suitable to be applied into an axial-flow pump and/or a reversible pump-turbine.

Rotation machines, being called by turbo-machines, can be classified into the followings, from viewpoints of the fluid, which is deal with therein, and the types thereof:

1. Fluid, which is deal with:
   Liquid, and Gas.
2. Types:
   Axial flow, Diagonal flow, and Centrifugal types.

The pump, which is mainly used at present, comprises a bell mouth, a casing, a pump, and a diffuser, etc.

An impeller rotating within the pump casing is rotationally driven by means of a rotation shaft thereof, thereby giving energy to liquid, which is sucked from a suction casing. The diffuser has a function of converting a portion of velocity energy of the fluid into static pressure.

FIG. 12 shows a characteristic curve between pump head and flow rate (i.e., pump head-flow rate characteristic curve), being typical to such the turbo-machine as shown in FIG. 2, wherein the horizontal axis is a parameter indicative of the flow rate while the vertical one that indicative of the pump head. As is shown in this figure, the pump head comes down as the flow rate rises up, within a low flow rate region, however it shows a so-called right-uprising property (i.e., property of rising up at the right-hand side), in which the pump head rises up in proportion to rising-up of the flow rate, during when lying within S region. Further, when coming up to be more than the right-uprising property region, then the pump head falls down as the flow rate rises up, again.

When the turbo-machine is operated with the flow rate within the right-uprising property region S, mass of liquid generates the so-called surging phenomenon, where it oscillates or vibrates by exiting by itself within conduit lines. Re-circulation flow is generated at an outer periphery of the impeller inlet, when the flow rate of liquid flowing through the turbo-machine comes down, however swirl is generated in the liquid through narrowing in flow channel for the liquid entering into the impeller blades or vanes, therefore the right-uprising property is caused (see FIG. 2).

The surging gives damages, not only upon the turbo-machine, but also on the pipes, which are connected with in an upper stream and a down stream, therefore the turbo-machine is inhibited from operating stably in that low flow-rate region. Also, for enlarging the operation region of the turbo-machine, various methods are proposed for suppressing the surging, as described below, other than improvements of profile of the impeller blade:

1. Casing Treatment:

This is for the purpose of improvement in stall margin, by forming thin grooves at 10–20% of chord length of the impeller blade. Namely, with the casing treatment being proposed previously, the grooves are formed on the casing inner wall, within the region where the impeller blades lie or reside, in an axial direction, in peripheral direction (i.e., on the periphery thereof) or an oblique direction, while directing in a radius or slantwise.

2. Separator:

This is for the purpose of preventing the re-circulation flow from being enlarged therein, wherein a separator is disposed for separating a reverse-flow portion of the re-circulation flow from a down-stream portion thereof, which is generated at an outer edge of the impeller blade inlet within the low flow rate region.

As examples of the separators, which are applied into an axial-flow type hydraulic machine (one of the turbo-machines), include a suction-ring method, a blade-separator method, and an air-separator method.

With the suction-ring method, the reverse-flow is enclosed within an outside of the suction-ring, and with the blade-separator method, a fin is provided between the casing and the ring. Also, with the air-separator method, moving blades or vanes are opened at tip portions thereof, to guide the reverse-flow into an outside of the casing, thereby preventing the reverse-flow from revolution thereof by means of the fin, and this is large in effect, comparing to both of the two mentioned above, however it comes to be large in scale of the apparatus.

As the conventional art for obtaining such the right-uprising pump head, enabling the stable operation, the provisions of such the casing treatment and the separators are already known, as was mentioned in the above. The prior art of such kind is described in the specification of, for example, U.S. Pat. No. 4,212,585, etc.

Other than this, as is described in Japanese Patent Laying open No. 2000-303995 (2000), also a pump is proposed, which comprises a plural number of grooves are formed upon the inner case surface of a diagonal flow pump, connecting the impeller blade inlet side to within a region on an inner case surface where the blades lies, to suppress the revolution or swirl in an inlet, thereby obtaining a pump head curve having no such the right-uprising property thereon.

With such the casing treatment and the separators of the conventional art mentioned above, it is possible to shift the right-uprising property of the pump head curve into the lower flow rate side, so as to enlarge the stable operation region, however the axial-flow type hydraulic machine is lowered in the efficiency thereof, by 1% for each increase of 10% in the loss margin, with the casing treatment.

Also, with the machine, in which the grooves are formed connecting between the impeller blade inlet side and the region on casing inner surface where the blades lie or reside, the grooves can be formed easily, and the decrease in the efficiency is small, and further it is possible to obtain the pump head curve of no such the right-uprising property. However, no consideration was paid upon the fact that pulsation occurs in pressure due to interference between the flow from the blades and the grooves, when the blades pass by the plural number of grooves formed on the casing inner surface, therefore there is a probability of increasing the vibrations and/or noises.

Further, in the turbo-machine, such as the axial-flow type hydraulic machine, cavitations may occur in the vicinity of the impeller blade inlet thereof. The cavitations are phenomena of generating a large number of bubbles in a liquid due to vaporization when pressure comes down to the vicinity of saturation vapor pressure of the liquid, which flows into the pump, and the generated bubbles flow within an inside of the pump and collapse accompanying with pressure recovery therein. The generation of cavitations may brings about harmful effects, such as, an increases of vibration or/and noises and a low performance sometimes, as well as, injuring the impeller and the wall surface of the casing.

NPSH is called by "Re. NPSH", being necessary for the pump to generate no such cavitations therein under a certain operation condition thereof. The NPSH means the available head (i.e., the net positive suction head), and indicates the height of total pressure of the liquid above the reference level of the impeller, comparing to the saturation vapor pressure of the liquid under that temperature. The lower the NPSH, the nearer to the saturation vapor pressure: thus, in the condition where the cavitations can be generated easily. Namely, it can be expressed that, the lower the "Re. NPSH", the more difficult the cavitations to be generated in the pump.

Though the situations or conditions of generating the cavitations are various depending upon the operating condition thereof, however in the axial-flow and/or the diagonal-flow pump, the "Re. NPSH" has a tendency to be high in the small flow-rate where the right-uprising property appears. Namely, it is in the condition where the cavitations can be easily generated.

SUMMARY OF THE INVENTION

An object, therefore according to the present invention, is to improve or dissolve such the right-uprising property in the pump head-flow rate characteristic curve, and thereby obtaining an axial-flow type hydraulic machine, which enables enlargement of the operation range.

Other object, according to the present invention, is to provide an axial-flow type hydraulic machine, which is able to suppress decrease in the efficiency, and increases of the vibrations and/or the noises, as well, in particular, within a stable operation range in the vicinity of a design point.

Further other object, according to the present invention, is to provide an axial-flow type hydraulic machine, for improvement thereof, being free from such the decreases in performances due to the cavitations.

For accomplishing such the objects as mentioned above, according to the present invention, first of all, there is provided an axial-flow type hydraulic machine, comprising: a casing, in which an axial flow impeller having a plural number of blades is disposed in a freely rotatable manner; a casing liner being provided on an inner surface of said casing in an axial direction, in a freely rotatable manner; and a plural number of flow passages being formed on the inner surface of said casing liner aligning in peripheral direction thereof, for connecting between an inlet side of said impeller and an inside of blade residing region in a pressure gradient direction, wherein said casing liner is movable in the axial direction, so as to changing said flow passages in position thereof, to vary an interference length defined between said impeller, whereby making flow rate of fluid flowing in said flow passages into the pressure gradient direction being adjustable.

According to the present invention, secondly, there is provided an axial-flow type hydraulic machine, comprising: a casing, in which an axial flow impeller having a plural number of blades is disposed in a freely rotatable manner; a plural number of grooves in pressure gradient direction, being formed on the inner surface of said casing aligning in a peripheral direction thereof, for connecting between an inlet side of said impeller and an inside of blade residing region on the inner surface of said casing; and a movable member being movable in an axial direction on the inner surface of said casing, whereby all or a part of said grooves in a portion opposing to the impeller blades are constructed to be able to open/or close.

In the axial-flow type hydraulic machine mentioned in the above, according to the present invention, wherein said movable member is structured to be cylindrical in a shape thereof, and so constructed that moving of said movable member to a suction side or a discharge side brings about a condition of the grooves being open in a portion opposing to said impeller blades. Also, wherein an interference length defined between the grooves and the impeller blades can vary depending upon position of said movable member, thereby making flow rate of fluid flowing in said flow passages in the pressure gradient direction being adjustable.

According to the present invention, thirdly, there is provided an axial-flow type hydraulic machine, comprising: a casing, in which an axial flow impeller having a plural number of blades is disposed in a freely rotatable manner; wherein, a portion of said casing opposing to the impeller is structured to be movable in an axial direction; and a plural number of grooves in an axial direction, being formed on an inner surface of said casing aligning in a peripheral direction thereof, for connecting between an inlet side of said impeller and an inside of blade residing region in a fluid pressure gradient direction, wherein movement of said casing into the axial direction changes said grooves in position thereof varies an interference length defined between said impeller, whereby making flow rate of fluid flowing in said flow passages in the pressure gradient direction being adjustable.

In the axial-flow type hydraulic machine mentioned in the above, according to the present invention, wherein other casing is disposed to overlap with a portion where the grooves of said movable casing, whereby to close the grooves, and being constructed, so that movement of said movable casing in the axial direction brings the grooves to appear in the blade residing region. Also in the axial-flow type hydraulic machine mentioned in the above, further comprising grooves communicating in a peripheral direction, which are communicated with said grooves in the axial direction and are provided in a downstream side in a main flow direction, and wherein movement of said movable casing into the axial direction brings the grooves communicating with, in the peripheral direction, to appear in the blade residing region.

According to the present invention, fourthly, there is provided an axial-flow type hydraulic machine, comprising: a casing, in which an axial flow impeller having a plural number of blades is disposed in a freely rotatable manner; a plural number of grooves in a pressure gradient direction, being provided on an inner surface of said casing aligning in a peripheral direction thereof, for connecting between an inlet side of said impeller and an inside of blade residing region on the inner surface of said casing, so as to take out fluid of pressure, which is necessary for suppressing generation of pre-swirl within main flow at an impeller inlet; and a movable member being constructed to be movable in an axial direction within said grooves, whereby being able to open/close a portion of said grooves opposing the blades.

According to the present invention, fifthly, there is provided an axial-flow type hydraulic machine, comprising: a casing, in which an axial flow impeller having a plural number of blades is disposed in a freely rotatable manner; a plural number of grooves in a pressure gradient direction, being provided on an inner surface of said casing aligning in a peripheral direction thereof, for connecting between an inlet side of said impeller and an inside of blade residing region on the inner surface of said casing; and a movable member being constructed to be move within said grooves, whereby being able to open/close said grooves.

In the axial-flow type hydraulic machine mentioned in the above, according to the present invention, wherein said movable member is constructed to move in a radial direction, and is able to change depth of said grooves depending upon an amount of movement thereof, whereby enabling adjustment on an amount of fluid flowing within said grooves. And also, wherein said movable member is provided to be rotatable around a fulcrum at one end thereof, and is able to change depth of said grooves depending upon an amount of rotational movement thereof, whereby enabling adjustment on an amount of fluid flowing within said grooves.

According to the present invention, sixthly, there is provided an axial-flow type hydraulic machine, comprising: a casing, in which an axial flow impeller having a plural number of blades is disposed in a freely rotatable manner; a plural number of grooves formed into pressure gradient direction, being provided on an inner surface of said casing aligning in a peripheral direction thereof, for connecting between an inlet side of said impeller and an inside of blade residing region on the inner surface of said casing; and a movable member being constructed to be move on an inner surface of said casing in peripheral direction, whereby being able to open/close said grooves.

And, in the axial-flow type hydraulic machine mentioned in the above, according to the present invention, it is preferable that each of the grooves formed in said pressure gradient direction has width being equal or greater than 5 mm and depth being equal or greater than 2 mm, and further the width of the groove is greater than the depth thereof.

Also, in the axial-flow type hydraulic machine mentioned in the above, according to the present invention, it is preferable that the grooves formed in said pressure gradient direction are structured, so that total width thereof occupies about 30–50% to a periphery length of the inner surface of said casing where said grooves reside therein, while the depth thereof is about 0.5–2% of a diameter of the inner surface of said casing where said grooves reside therein and about 10–30% of the width of said groove, and further each the groove is constructed, so that it is about 20–50% of length of the blade in a portion thereof opposing to the blades.

As was mentioned in the above, with provision of a plural number of grooves provided on an inner surface of a casing in the peripheral direction, being formed into the pressure gradient direction, for connecting between the inlet side of the impeller and an inside of blade residing region of the casing inner surface, it is possible to change the shape of the grooves opposing to the impeller responding to the operation condition of the pump. With this, it is possible to change an interference length between the impeller and the grooves, etc., thereby controlling an amount of fluid flowing within the grooves.

BRIEF DESCRIPTION OF THE DRAWINGS

Those and other features, objects and advantages of the present invention will become more apparent from the following description when taken in conjunction with the accompanying drawings, wherein.

DETAILED DESCRIPTION OF PREFERRED EMBODIMENTS

Figure 1A:
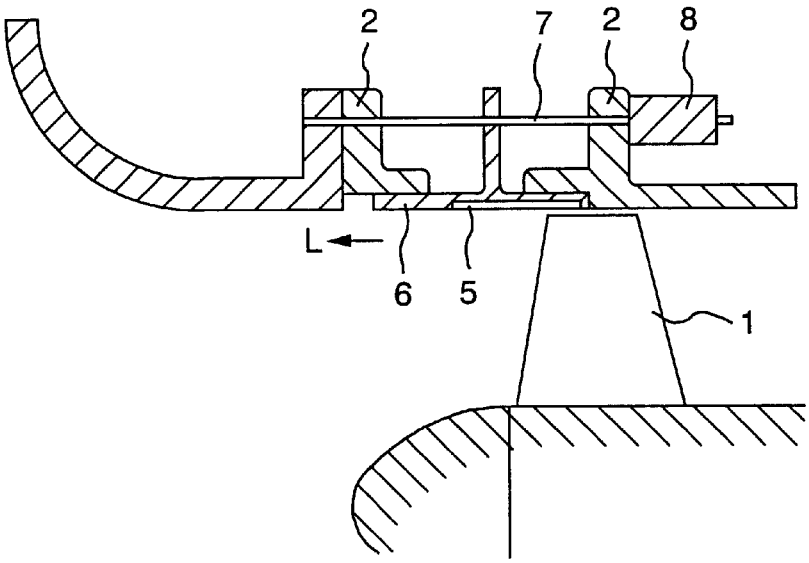
FIGS. 1(*a*) and 1(*b*) are meridional cross-section views for showing principle portions of an axial-flow type hydraulic machine, according to an embodiment of the present invention.

With a pump, which is designed by taking the efficiency thereof into the consideration, it has a tendency of showing the right-uprising property in a portion of the pump head curve, especially in the vicinity of the flow rate of 50%–70%, when the flow rate at the maximum efficiency is designed at the 100% flow rate. Even with the pump, not being designed by taking the efficiency into the consideration, it also has a tendency of causing a flat portion in the pump head curve, in the vicinity of the flow rate of 50%–70%.

An operation flow rate of the pump can be determined at an intersection point among the three: thus, the actual pump head, being determined as difference between the suction side water level at the pumping station or plant; the resistance curve, being sum of resistances of pipelines of that pumping station; and the pump head curve of the pump. If the pump head includes such the right-uprising region in a portion of the curve thereof, sometimes the cases happen, where the intersection point between the pump head curve and the resistance curve results to be plural in the number thereof, and in such the cases, the intersection point cannot be determined uniquely, at a one point, and then the flow rate cannot be determined, therefore the pump discharge amount fluctuates within an unstable region thereof, thereby falling into an uncontrollable condition thereof.

For this reason, i.e., for the purpose of obtaining a balance between the maximum efficiency and the stability of pump head, thereby obtaining the pump head curve without such the right-uprising property, the maximum efficiency has a tendency to come down. Also, in a case where the pump includes such the unstable region, an operation manual was prepared, not to bring the pump operation into the unstable region, thereby achieving the control thereof. However, with the pump having rotation speed control, since it can be operated up to the region where the intersection point of the resistance curve does not fall within the unstable region, therefore, in particular when being required to operate over the ranges falling within the unstable region, the pump must be prepared in plural number thereof, to be controlled, while making the each pump small in the pump capacity. For this reason, there is a problem that the facilities and the control method come to be complex, thereby bringing about rising-up of the cost thereof.

Also, with the conventional method for obtaining the stability of the pump head curve, it has a problem that the efficiency comes down, thereby the consumed power becoming large.

The present invention has a superior feature of dissolving such the problem mentioned above. However, upon the present invention, it is found out that pressure pulsation is generated due to an interference between the grooves and the flow from the impeller when the impeller blade passes by the grooves, and that the pressure pulsation excites the pump, i.e., a new problem that it increases vibrations and noises which are generated from the pump main body and/or the pipe lines thereof. Then, measure is necessary for the noises/vibrations, in particular when such the pumping station is installed neighboring with a residential area, or when the residential area is constructed in circumference of the pumping station.

Explanation will be given on an embodiment according to the present invention, in which improvements can be achieved on the right-uprising property, by taking the measure for the noises/vibrations into the consideration, and further on the cavitations in the small flow rate.

Further, the present invention is effective, in particular, when the speed ratio Ns ($Ns=N\times Q^{0.5}/H^{0.75}$), being an index indicative of the characteristics of the pump, lies around from 1,000 to 2,200, assuming that the rotation speed of the pump is N (rpm), the total head H(m), and the discharge amount Q ($m^3$/min), and when the actual head, being determined by the suction water level and the discharge water level in the pumping station, is equal to or greater than 50% of the head of the specification point of that pump.

Hereinafter, embodiments according to the present invention will be fully explained by referring to the attached drawings.

Figure 2:
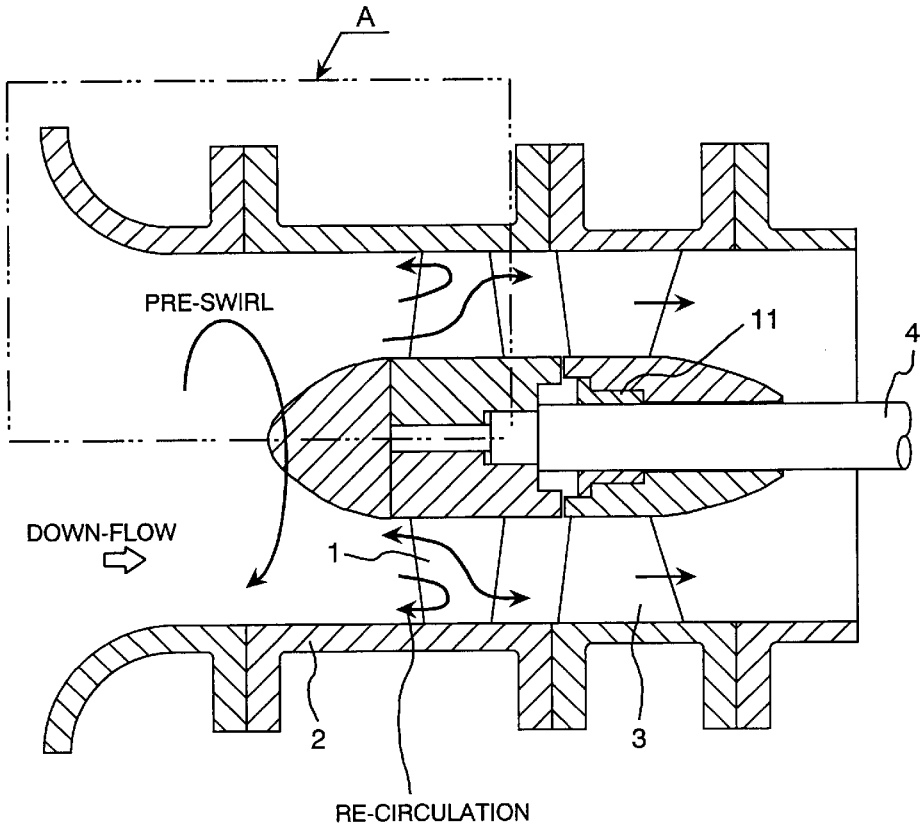
FIG. 2 is a total vertical cross-section view for showing a representative example of an axial-flow pump, as one of the axial-flow type hydraulic machines.
Figure 3:
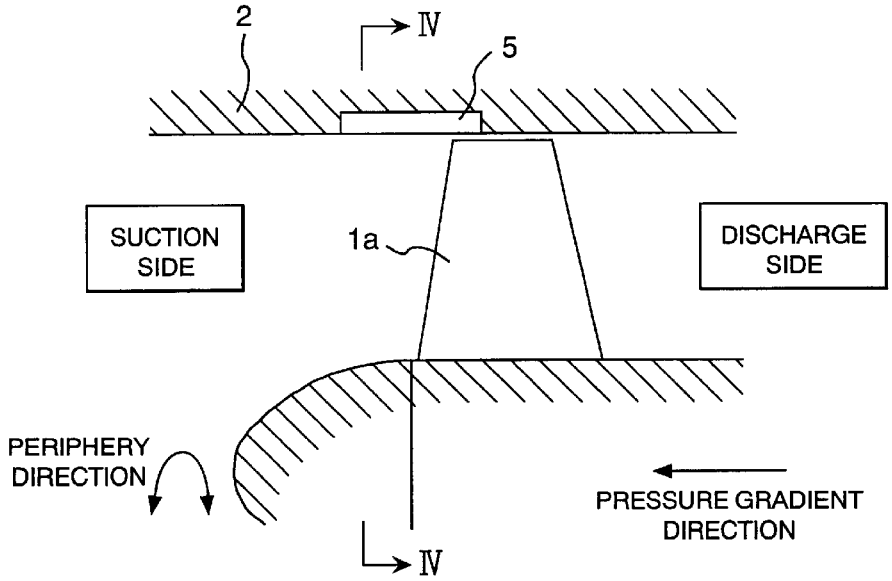
FIG. 3 is a meridional cross-section view for showing a principle portion of the axial-flow type hydraulic machine, having grooves formed in pressure gradient direction.
Figure 4:
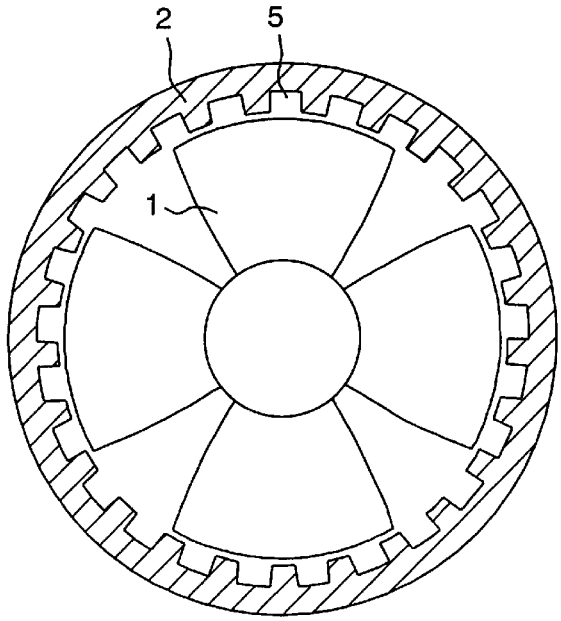
FIG. 4 is a cross-section view along with IV—IV arrows in FIG. 3 mentioned above.

FIG. 2 is a total cross-section view for showing a representative example of the axial-flow pump, as a one of the axial-flow type hydraulic machines. In the figure, a reference numeral 1 indicates an impeller having axial flow blades or vanes, which is provided in freely rotatable manner within a casing 2, for example, by means of a rotation shaft 4. A reference numeral 3 is a wicket gate (guide vanes), and it guides the flow from the impeller 1 and also supports a shaft bearing 11 for supporting the rotation shaft 4 thereon. In the structure of a portion in the vicinity of a portion A, which is indicated by surrounding by two-dot chain line in FIG. 2, grooves 5 are formed in a plural number of pieces, as shown in FIG. 3, for example, i.e., connecting between the blade inlet side and within the blade residing region in the pressure gradient direction of liquid pressure. FIG. 4 is a view along with IV—IV arrows in FIG. 3 mentioned above; thus, being a view of the casing 2 and the impeller 1 seen from a front surface thereof. The grooves 5 are provided or formed on an inner surface of the casing 2 aligning in peripheral direction thereof, and each has a shallow groove, in which the depth is smaller than the width in the structure thereof. Also, the grooves 5 are formed in the direction of pressure gradient of liquid, covering from a middle portion of a tip of blade up to a position where the re-circulation flow generates when the flow rate is low. With provision of such the grooves 5, the liquid being increased in pressure by the impeller 1 flows backwards, directing from a one terminal position of the grooves in downstream side up to the other in upstream side, so as to spout out at a position where the re-circulation flow (i.e., the reverse flow at the impeller blade inlet) generates when the flow rate is low, thereby suppressing the generation of the re-circulation flow. Thus, it is possible to suppress the main flow to be affected by the pre-swirl due to there-circulation flow, thereby preventing the generation of stall in rotation of blades of the impeller.

The groove 5, being formed in pressure gradient direction mentioned above, has width of 5–150 mm (preferably, 5–30 mm) and depth of 1–30 (preferably, 2–6 mm) in the structure thereof, depending upon sizes of the pumps, and it is preferable that the groove depth occupies about 5–50% (preferably, 10–30%) of the groove width. Also, the grooves are so structured, that total width of those grooves in occupies about 30–50% to a perimeter on inner surface of the casing where the grooves reside, while the groove depth is about 0.5–2% of a diameter on inner surface of the casing where the grooves reside, and further, it is preferable that a length of portion of the grooves, opposing to the impeller blades, is determined to be about 20–50% of the length of the blade in the structure.

Next, explanation will be given on the preferable structure, when the grooves 5 mentioned above is applied to the axial-flow type hydraulic machine, in more details thereof, by referring to FIGS. 1(*a*) and 1(*b*), and also FIGS. 5(*a*) to 11(*b*). Those FIGS. 5(*a*) to 10(*b*) are corresponding to the views enlarged, respectively, of a portion in the vicinity of the portion A, which is enclosed by the two-dot chain line in FIG. 2 mentioned above, and FIGS. 11(*a*) and 11(*b*) are corresponding to the cylindrical cross-section views thereof in the vicinity of the portion A.

Figure 1B:
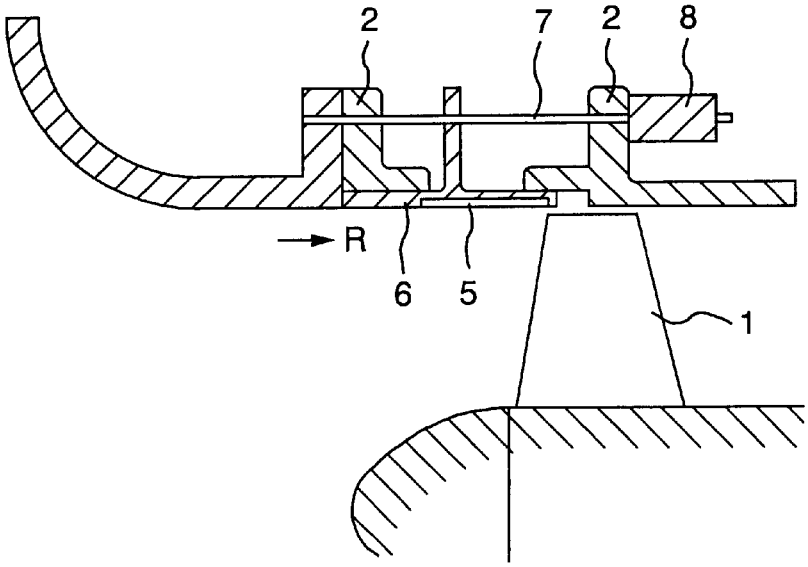

In an embodiment shown in FIGS. 1(*a*) and 1(*b*), a casing liner (a movable portion) 6 is provided on an inner surface of the casing 2, being freely movable in the axial direction thereof, and on an inner surface of this casing liner 6 are formed the grooves (flow passages) in plural number thereof, connecting between the inlet side of the blade and within the blade residing region in the gradient direction of liquid pressure, aligning in the peripheral direction thereof. The grooves 5 lying within the blade residing region 5 can be shifted in positions, by moving the casing liner 6 in the axial direction, therefore being able to change an interference length defined between the impeller. With this, it is possible to make an adjustment on the flow rate of the liquid flowing within the grooves, in particular in the gradient direction of liquid pressure.

As is shown in FIGS. 1(*a*) and 1(*b*), movement of the casing liner 6 to the right-hand side (R-direction) in the axial direction brings the impeller 1 and the grooves into a condition where they interfere with each other (see, FIG.

1(*a*)). In the operation region of a low flow rate, where the right-uprising property appears on the pump head-flow rate characteristic curve, the grooves and the impeller are brought into the condition as shown in FIG. 1(*a*); i.e., they interfere each other, so that a portion of the liquid increased in pressure by the impeller blades sprouts out at the position where the re-circulation flow may occur in the blade inlet side through the grooves. With this, the pre-swirl can be suppressed or prevented from disturbing the main flow at the impeller inlet, thereby improving or dissolving the right-uprising property on the pump head-flow rate characteristic curve.

Under the condition shown in FIG. 1(*a*), the interference occurs between the flow from the impeller 1 and the grooves 5, thereby generating the pressure pulsation. The generation of pressure pulsation excites the vibration of the turbomachine, thereby increasing the vibrations/noises. Therefore, according to the present invention, within the operation region other than where the right-uprising property appears on the pump head-flow rate characteristic curve, the casing liner 6 is shifted into the left-hand side (L-direction) on the axis, to be brought into the condition shown in FIG. 1(*b*), thereby bringing the grooves 5 and the blades to be free from the interference therebetween. With this, the pressure pulsation generated due to the interference occurring between the blades and the grooves 5 can be made small, thereby suppressing the increase in the vibrations/noises due to that pressure pulsation.

Figure 13:
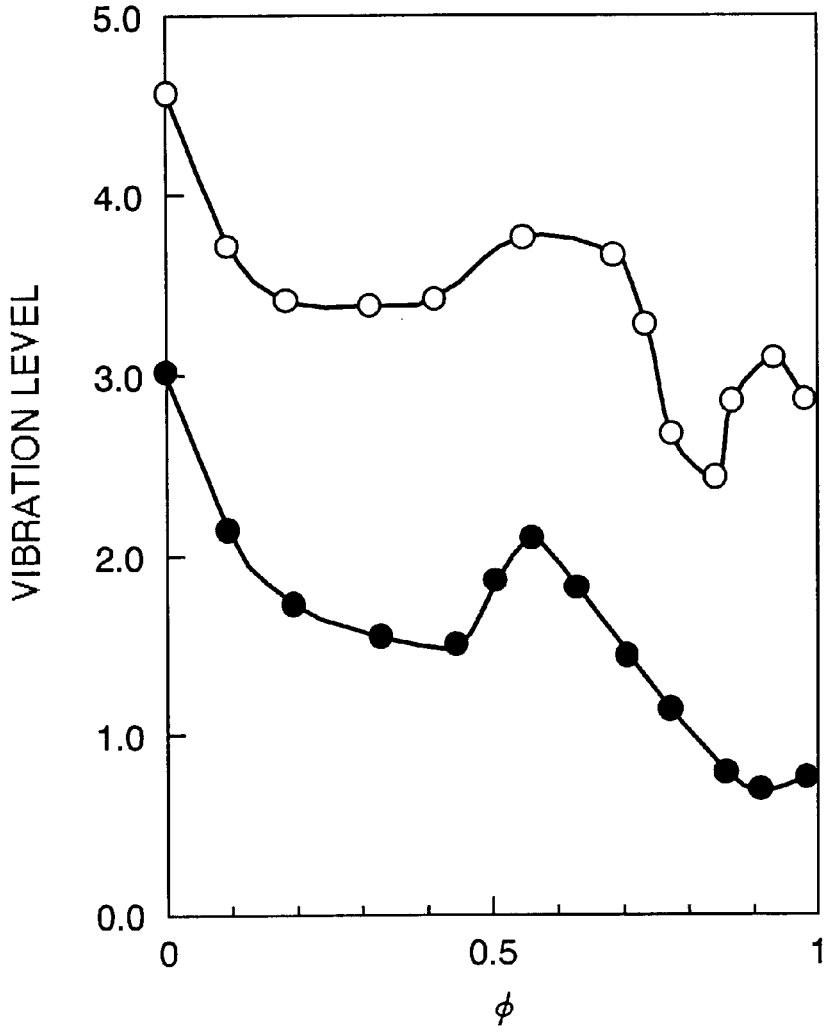
FIG. 13 is a graph for showing relationships between the flow rate and the vibration level, in the axial-flow type hydraulic machine according to the present invention and that of the conventional art.

FIG. 13 is a graph for showing the relationship of vibration acceleration, between cases, where the grooves 5 are provided and where no such groove is provided, for comparison therebetween. The horizontal axis indicates the flow rate Φ of no dimension, while the vertical one the vibration acceleration (i.e., vibration level). In the graph, a black circle indicates the vibration acceleration when no groove is provided on the casing, while a white circle when the grooves are provided on the casing. As is clearly shown in this figure, comparing to the case where no groove is provided, it can be seen that the vibration acceleration is increased over all the regions of flow rate in the case where the grooves 5 are provided on the casing.

In the present embodiment, having the structure of being able to shift the grooves, since the interference can be reduced depending upon the operation condition, the vibration can be suppressed down to the level similar to the condition of having no groove, in a specific operation region. It can be said this is also true on the noises.

Further, according to the present embodiment, with provision of the grooves 5, an effect can be also achieved, in that an improvement can be obtained on the performances, which is reduced due to the cavitations generated on the impeller. Namely, in the operation region where the right-uprising property appears, there is a tendency that the reduction in performances due to the cavitations becomes remarkable, accompanying with the reverse flow (flow back) generated by exfoliation and/or stall of the impeller. On the contrary to this, since the flow can be improved within the impeller through suppression of the revolution or swirl generated in the inlet, it is possible to suppress generation of the cavitations, and also to lessen the reduction in performances due to the cavitations.

Figure 14:
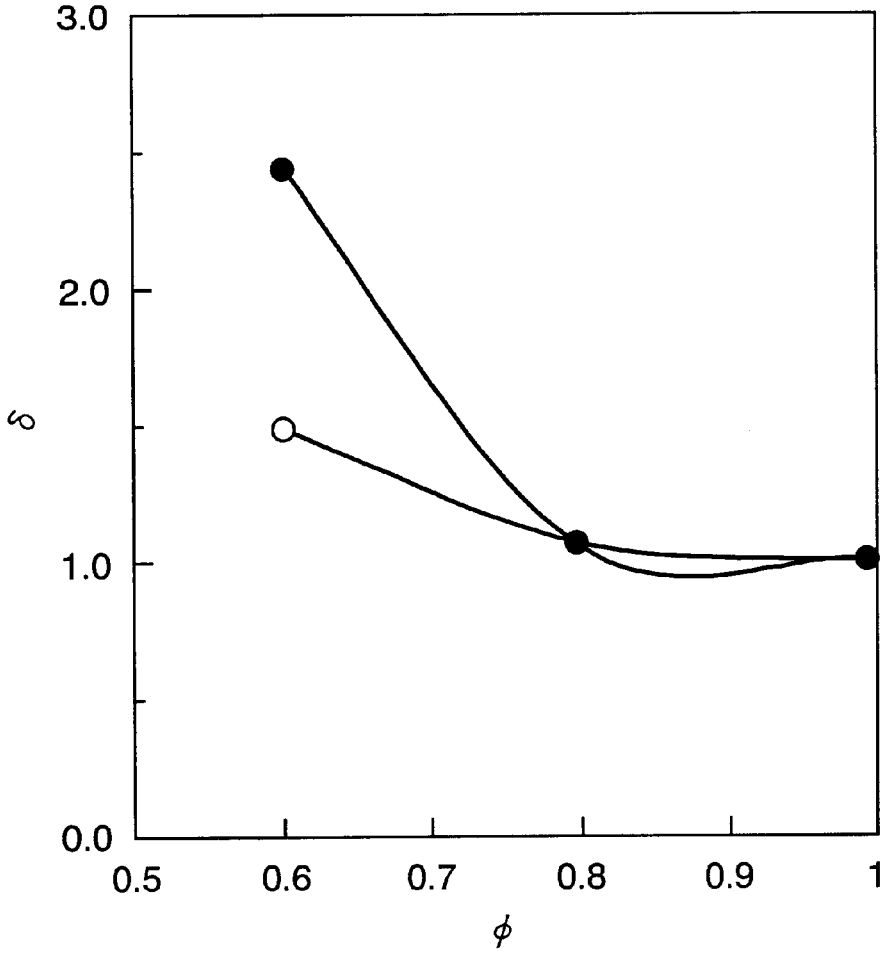
FIG. 14 is a graph for explaining about a relationship between the flow rate and the cavitations, in the axial-flow type hydraulic machine according to the present invention and that of the conventional art.

FIG. 14 is a graph for showing a relationship of performance against cavitations, between cases where the grooves 5 are provided and where not provided, for comparison therebetween. The horizontal axis indicates the flow rate Φ of no dimension, while the vertical one the "Re. NPSH" (δ) of no dimension. In the graph, a black circle indicates the cavitations generated when no groove is provided on the casing, while a white circle when the grooves are provided on the casing. It can be seen that, although the performance against cavitations is deteriorated or comes down when the flow rate of no dimension is 0.6 in the case where no such groove is provide, but the performance against cavitations can be improved greatly, with the provision of the grooves.

Next, explanation will be given about the mechanism for moving the casing liner (a movable member) 6, by refereeing to FIGS. 1(*a*) and 1(*b*). A shaft 7 passes or penetrates through the casing 2 at the suction side, the movable member 6, and the casing 2 at the discharge side, and on the casing of the discharge side is provided a motor 8. The movable member 6 and the shaft 7 are connected with each other through screws, and they are so structured that the movable member 6 can be shifted in the L-direction or the R-direction through the screw portion. However, as such the movable mechanism, for example, a hydraulic cylinder may be applied other than the motor. For control of the moving mechanism are provided a pressure sensor for measuring inner pressure of the pump, an ultrasonic flow rate meter or an electromagnetic flow rate meter for measuring the discharge amount of the pump, etc., and they are constructed so that the movable portion is moved by the motor or the cylinder when the inner pressure or the discharge amount comes up to a predetermined value, thereby enabling automatic control.

Figure 5A:
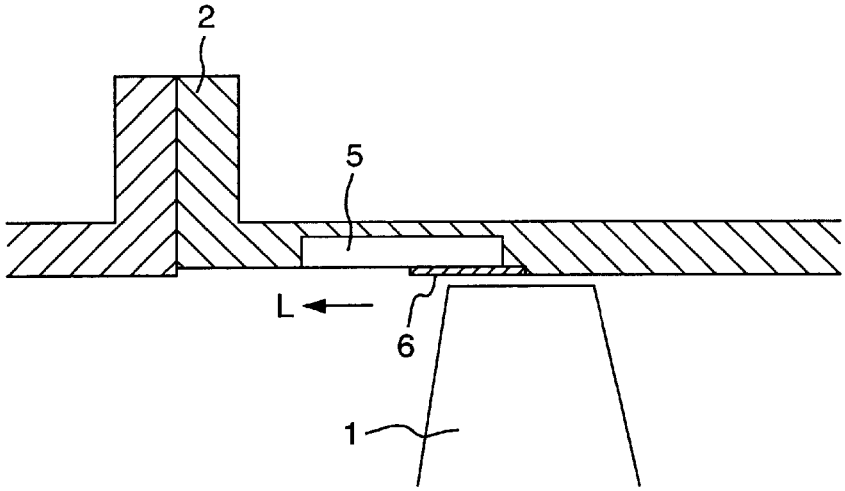
FIGS. 5(*a*) and 5(*b*) are meridional cross-section views for showing principle portions of an axial-flow type hydraulic machine, according to other embodiment of the present invention.
Figure 5B:
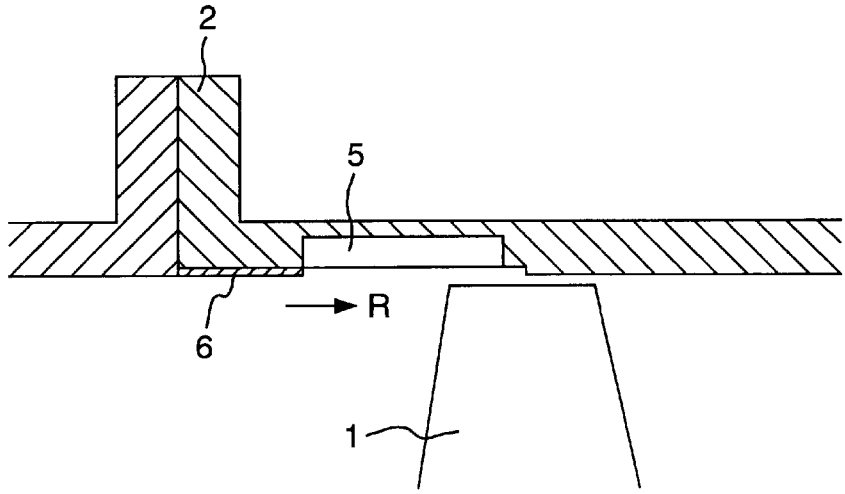

In an embodiment shown in FIGS. 5(*a*) and 5(*b*), the movable member 6 is provided to move on the inner surface of the casing in the axial direction, thereby being able to open or close all or a portion of the grooves 5 formed in the pressure gradient direction, which are provided in a plural number on the casing inner surface aligning in the peripheral direction thereof, for connecting between the impeller inlet side and an inside of the blade residing region on the casing inner surface. The movable member 6 is constructed in a cylindrical shape, and in the example shown in FIGS. 5(*a*) and 5(*b*), it is built up in such the mechanism that a portion of the grooves opposing to the blades mentioned above is brought into the opened condition, through movement of the movable member 6 into the suction side (L-direction), as shown in FIG. 5(*b*). Thus, under the condition shown in FIG. 5(*b*), the blades and the grooves 5 interfere with each other, and the operation can be obtained, under which the right-uprising property can be improved or removed on the pump head-flow rate characteristic curve. Also, movement of the movable member 6 to the discharge side (R-direction) can brings the blades and the grooves 5 into the condition where no interference occurs between them; i.e., in the condition where no groove 5 lies within the blade residing region, therefore it is possible to suppress the increases in vibrations/noises caused by the pressure pulsation due to the interference between the blades and the grooves 5. By constructing them in this manner, it is possible to change the length of interference between the grooves and the blades through the position of the movable member 6, thereby adjusting the flow rate of liquid flowing in the gradient direction of liquid pressure within the grooves.

Figure 6A:
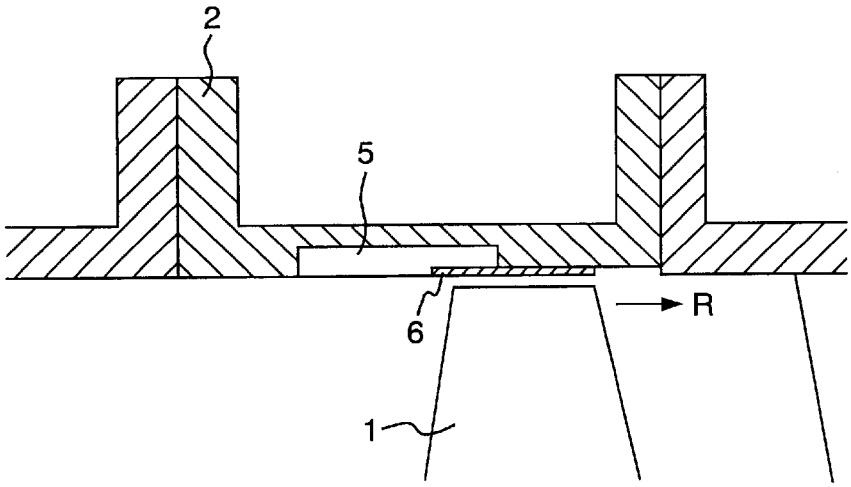
FIGS. 6(*a*) and 6(*b*) are meridional cross-section views for showing principle portions of an axial-flow type hydraulic machine, according to further other embodiment of the present invention.
Figure 6B:
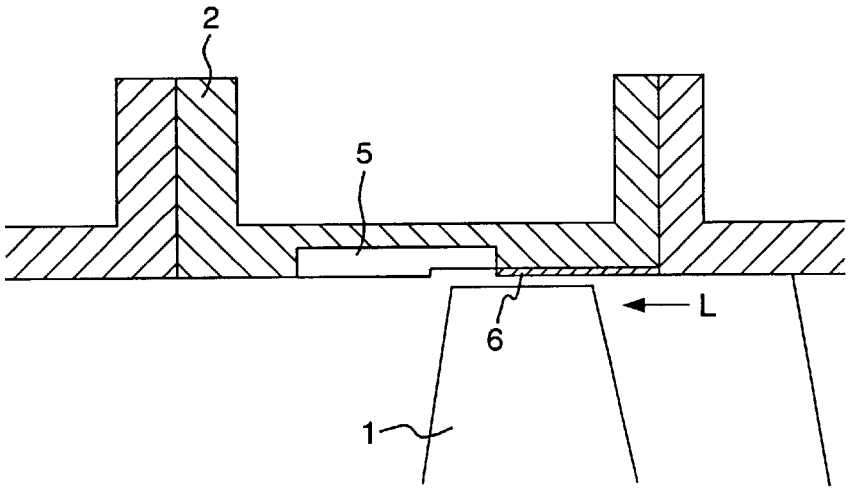

Further, in the similar manner, it is also possible to obtain a mechanism, in which the grooves are brought into opening condition in the portion opposing to the blades by shifting the movable member 6 mentioned above into the discharge side (R-direction), and an example of this will be explained by referring to FIGS. 6(*a*) and 6(*b*). In those FIGS. 6(*a*) and 6(*b*), on the inner surface of the casing 2 are provided the grooves 5 and the movable member 6 in a cylindrical shape, which is movable in the axial direction. Shifting the movable member 6 into the R-direction can bring the blades and the grooves 5 into the condition where they interfere with each other, as shown in FIG. 6(*b*), thereby enabling an operation, under which the right-uprising property can be improved or removed on the pump head-flow rate characteristic curve. Also, shifting the movable member 6 into the L-direction can bring about the condition where no interference occurs between the blades and the grooves 5, as shown in FIG. 6(*a*); i.e., in the condition same to where no groove lies within the blade residing region, therefore it is possible to suppress the vibrations/noises due to the interference generating between the blades and the grooves 5. The shifting of the moveable member 6 in this manner can enable the control of liquid flowing through the grooves, by changing the length for causing interference between the grooves 5 within the blade residing region and the impeller 1.

Figure 7A:
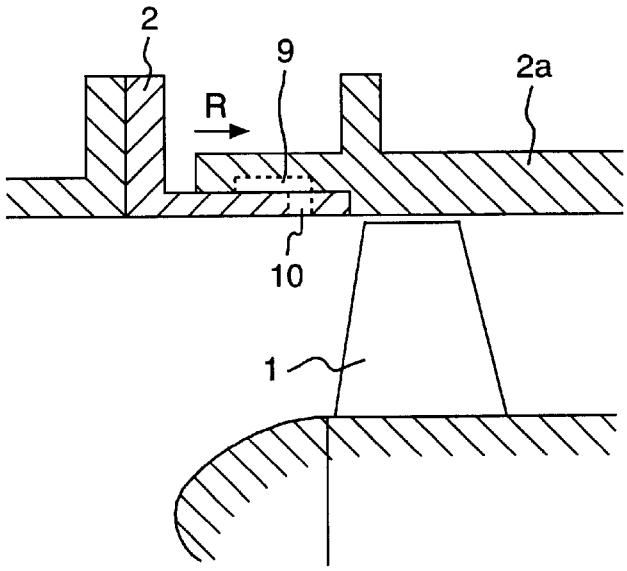
FIGS. 7(*a*) and 7(*b*) are also meridional cross-section views for showing principle portions of an axial-flow type hydraulic machine, according to further other embodiment of the present invention.
Figure 7B:
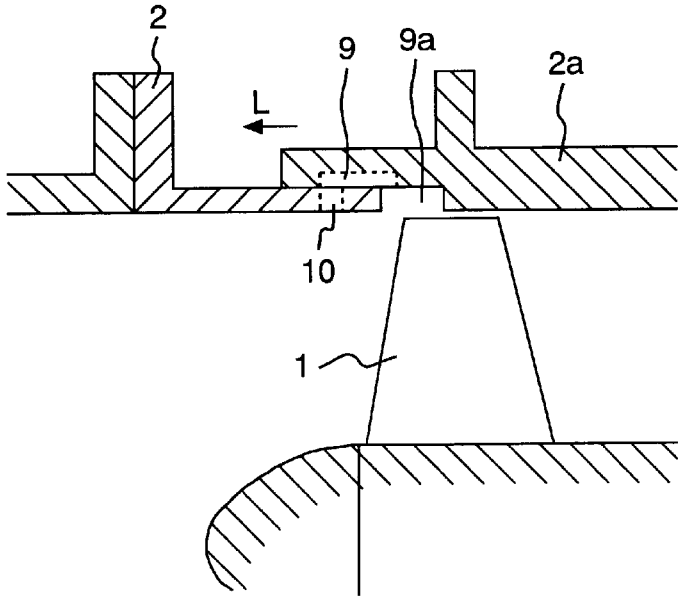

In an embodiment shown in FIGS. 7(*a*) and 7(*b*), a portion of the casing 2*a* (the movable member) opposing to the impeller, in the casing 2, is structured to be movable in the axial direction, while upon the inner surface of the movable casing 2*a* are formed grooves (i.e., the flow passages) 9 in the axial direction, being provided in a plural number and aligning in the peripheral direction thereof, for connecting between the impeller blade inlet side and an inside of the blade residing region in the gradient direction of liquid pressure. Shifting the casing 2*a* into the axial direction can change the position of the grooves 9, to vary the length for causing an interference between the impeller 1, thereby enabling an adjustment on the flow rate of liquid flowing into the gradient direction of liquid pressure within the grooves 5.

Also, in this embodiment, the casing 2 is disposed, so that it overlaps with the portion of the grooves 5 formed on the movable casing 2*a*, thereby closing the grooves, and it is also constructed, so that the grooves appear within the blade residing region when the movable casing 2*a* is shifted into the axial direction. Further, this embodiment comprises also communication grooves (i.e., the flow passages) 9*a*, being formed to communicate with the grooves in the axial direction mentioned above, and being provided in the peripheral direction in the downstream side; therefore, it is so constructed that the grooves communicating within the blade residing region in the peripheral direction appear when the movable casing 2*a* is shifted into the axial direction. Further, the above-mentioned grooves 9, as was described in the above, can be provided, not only as the grooves in the pressure gradient direction for connecting between the impeller inlet side and an inside of the blade residing region on the casing inner surface, but also as the flow passages for extending the grooves 9 in the peripheral direction, continuously. A reference numeral 10 indicates a hole, being provided at the position where it communicates with an upstream end (i.e., an end on the left-hand side) of the each flow passage (i.e., the groove 9) when the movable casing 2*a* is shifted to the right-hand side direction (R-direction), and this hole 10 is provided in a plural number, aligning in the peripheral direction. Those holes 10 are provided so as to spout out the fluid flowing into the upstream side backwards from the impeller through the flow passages 9 to the impeller blade inlet side where the re-circulation flow occurs.

Shifting the casing 2*a* into the R-direction can make the flow passages 9 and 9*a* appear on periphery side of the impeller blades, as shown in FIG. 7(*b*). A portion of the fluid being increased in pressure by the impeller 1 enters from the flow passages 9*a* formed in the peripheral direction and passes through the flow passages 9 formed in the axial direction (or formed in the peripheral direction), and then it spouts from the holes 10 into the region where the re-circulation flow occurs in the impeller blade inlet, thereby suppressing the pre-swirl from disturbing the main flow at the impeller inlet. As a result of this, it is possible to suppress the stall of impeller and to improve or remove the right-uprising property on the pump head-flow rate characteristic curve.

While, shifting the casing 2*a* into the L-direction can bring the blades and the flow passages, being formed by the casing 2*a* and the movable portion 6, into the condition where no interference occurs between them, as shown in FIG. 7(*a*); i.e., in a specific operation region (i.e., in an ordinary operation region where no such the right-uprising property appears), it is possible to maintain a preferable operation condition without causing the decrease in efficiency due to the fact that the portion of fluid, which is increased in pressure by the impeller, leaks out into the impeller blade inlet side, etc.

Figure 8A:
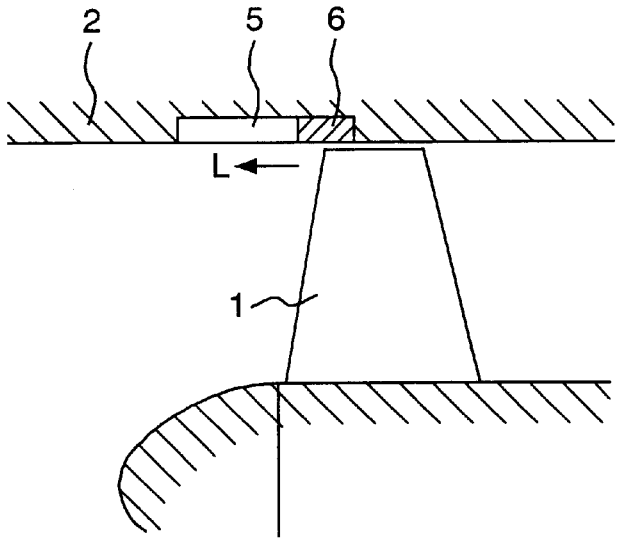
FIGS. 8(*a*) and 8(*b*) are also meridional cross-section views for showing principle portions of an axial-flow type hydraulic machine, according to further other embodiment of the present invention.
Figure 8B:
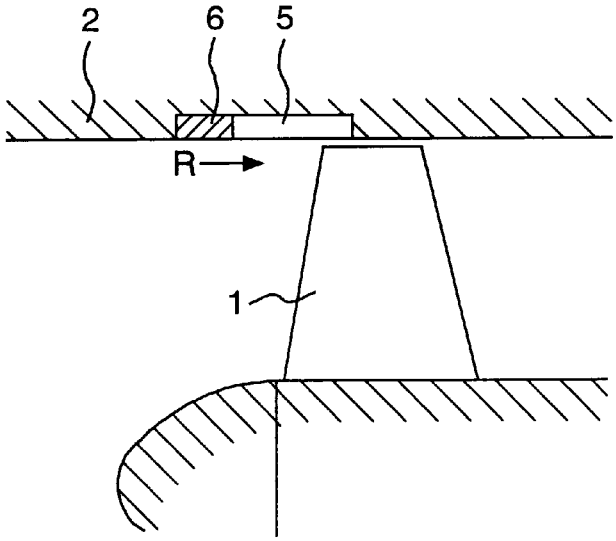

In an embodiment shown in FIGS. 8(*a*) and 8(*b*), upon the inner surface of the casing 2, in the similar manner as the examples mentioned in the above, a plural number of grooves 5 are formed on the casing inner surface aligning in the peripheral direction thereof, in the pressure gradient direction connecting between the impeller inlet side and an inside of the inside of the blade residing region. And, in those grooves 5 are installed the movable members 6, respectively, each being movable in the axial direction (in parallel with the groove) within the groove and structured to open and close a portion of the groove opposing to the impeller blades.

In the operation region where the right-uprising property appear on the pump head-flow rate characteristic curve of the axial-flow type hydraulic machine, the movable member 6 is shifted into the L-direction, as shown in FIG. 8(*b*), so that the grooves 5 appear within the blade residing region. This brings about a condition where the grooves 5 lie within the blade residing region, therefore, the portion of fluid, which is increased in pressure by the impeller, flows in an inside of the grooves to the impeller blade inlet side against the main flow, to spout out into the region where the re-circulation flow occurs in the impeller blade inlet, thereby suppressing the pre-swirl from disturbing the main flow at the impeller inlet. As a result, the rotating stall of impeller can be suppressed or prevented, and the right-uprising property on the pump head-flow rate characteristic curve can be improved or removed.

Also, in an ordinary operation region where no such the right-uprising property appears in the pump head-flow rate characteristic curve, the movable member 6 is moved into the R-direction, as shown in FIG. 8(*a*), and then the portion of the grooves opposing to the impeller blades is closed, thereby bringing about the condition where no groove lies within the blade residing region. With this, it is possible to suppress or prevent the generation of pressure fluctuation or pulsation due to the interference caused between the impeller blades and the grooves, in particular, in the operation region where no such unstable characteristic occurs, thereby preventing the vibrations/noises from being generated.

Further, in this example, an adjustment on the upstream end positions of the grooves 5 can be made, easily, thereby enabling the grooves to be brought into an appropriate shape thereof.

Figure 9A:
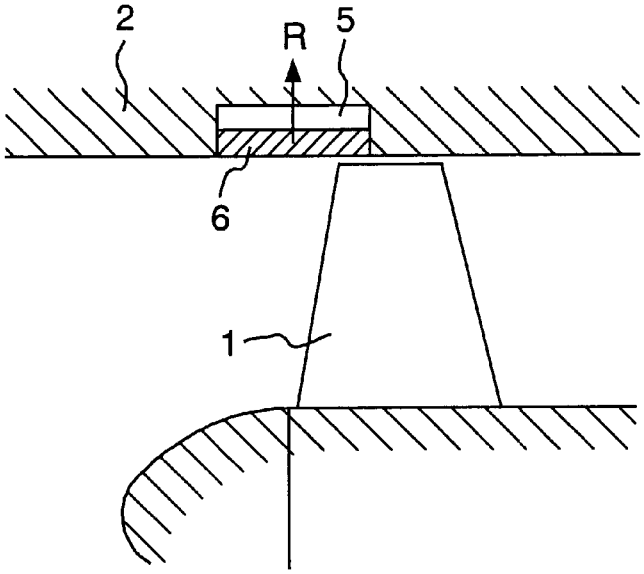
FIGS. 9(*a*) and 9(*b*) are also meridional cross-section views for showing principle portions of an axial-flow type hydraulic machine, according to further other embodiment of the present invention.
Figure 9B:
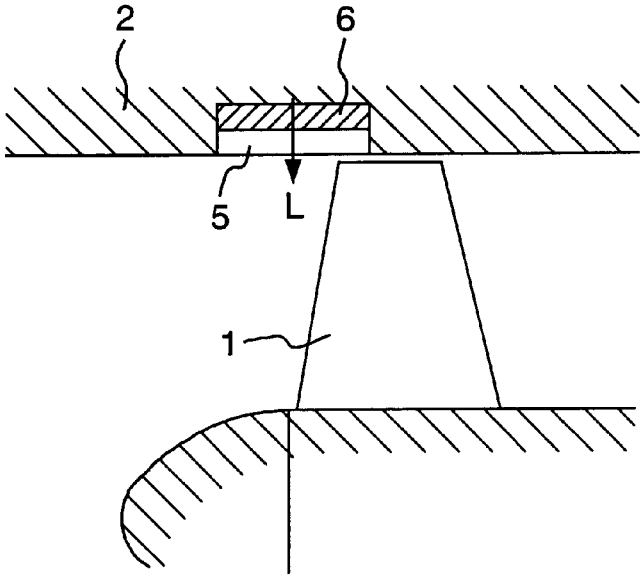

In an embodiment shown in FIGS. 9(*a*) and 9(*b*), in similar manner as the examples mentioned above, the grooves 5 formed in the pressure gradient direction are provided in a plural number aligning in the periphery thereof, and in each of the grooves 5, a movable member 6 is further provided, which has a thickness smaller than the depth of the groove, all over the total length of the groove, thereby accomplishing the movable member to move in the radial direction. Shifting of the movable members 6 in an outer diameter direction (R-direction), as shown in FIG. 9(*b*), can bring about a shallow groove, being wide in width, in a portion opposing to the impeller. Also, shifting of the movable member 6 into an inner diameter direction (L-direction), as shown in FIG. 9(*a*), can bring the groove 5 to close by means of the movable member; therefore it is possible to bring about the condition where no groove lies within the blade residing region.

With this construction, in an unstable operation region where the right-uprising property appears on the pump head-flow rate characteristic curve, the pump can operate under the condition shown in FIG. 9(*b*), therefore it can be improved in the right-uprising property of the characteristic curve. Also, in a stable operation region, where no such the right-uprising property appears, the operation can be made with efficiency increased, under the same condition where no groove is formed, as shown in FIG. 9(*a*).

Further, in the embodiment shown in those FIGS. 9(*a*) and 9(*b*), it is possible to make an adjustment on the depth of the groove, thereby bringing about the most suitable length thereof.

Figure 10A:
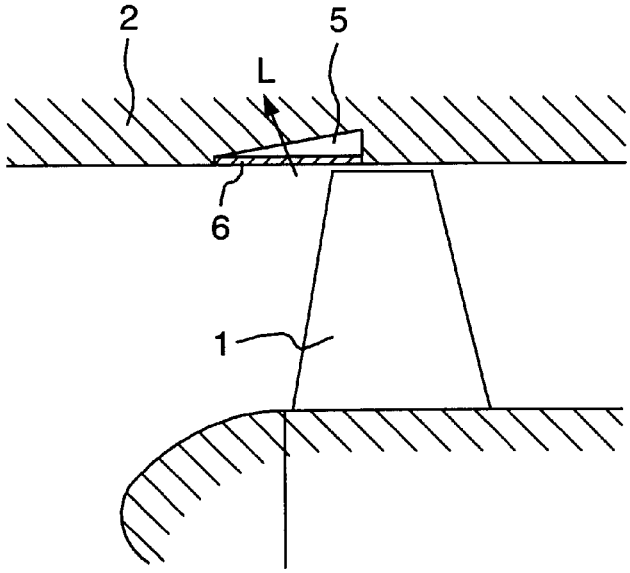
FIGS. 10(*a*) and 10(*b*) are also meridional cross-section views for showing principle portions of an axial-flow type hydraulic machine, according to further other embodiment of the present invention.
Figure 10B:
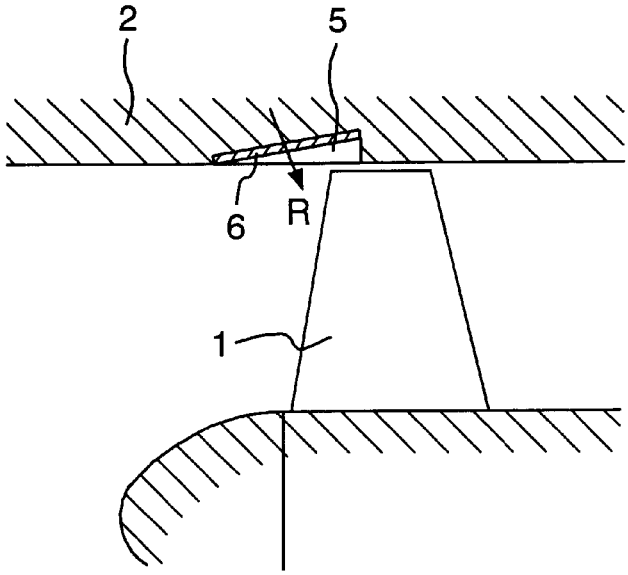

In the embodiment shown in FIGS. 10(*a*) and 10(*b*), in the similar manner as the example shown in FIGS. 9(*a*) and 9(*b*), the moveable member 6 is installed within the groove 5, however in this example, the movable member is so structured that it is able to fall down within the groove. In this embodiment, the groove 5 has a shape of being inclined on the bottom portion thereof, while the movable member is structured in such mechanism that it can rotate around the shallow portion of the groove (the upstream side of main flow) as a fulcrum.

In the unstable operation region where the right-uprising property appears on the pump head-flow rate characteristic curve of the axial-flow type hydraulic machine, rotation of the movable member 6 in the L-direction can bring the grooves 5 to appear within the blade residing region, as shown in FIG. 10(*b*), thereby enabling the operation with utilizing the grooves, in the similar manner as in the each example mentioned above. Also, in the stable operation region where no such the right-uprising property appears, the movable member 6 is turned into the R-direction, to bring about the condition that no groove lies within the blade residing region, thereby enabling an operation with efficiency increased.

Figure 11A:
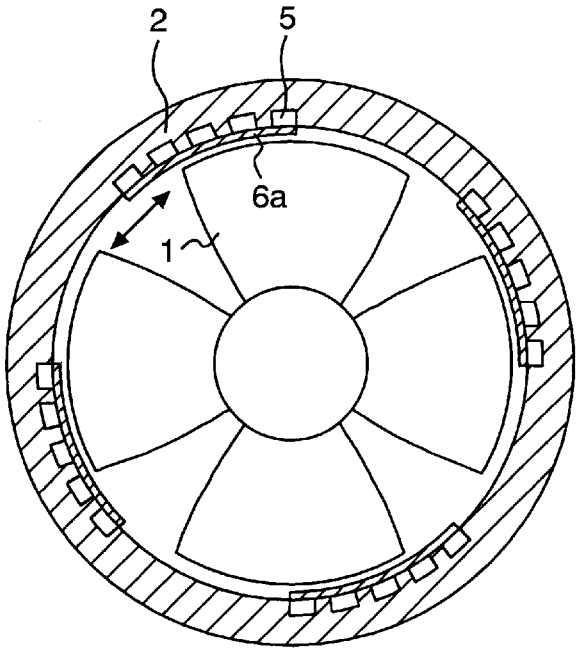
FIGS. 11(*a*) and 11(*b*) are cylindrical cross-section views for showing an axial flow hydraulic machine, according to further other embodiment of the present invention.
Figure 11B:
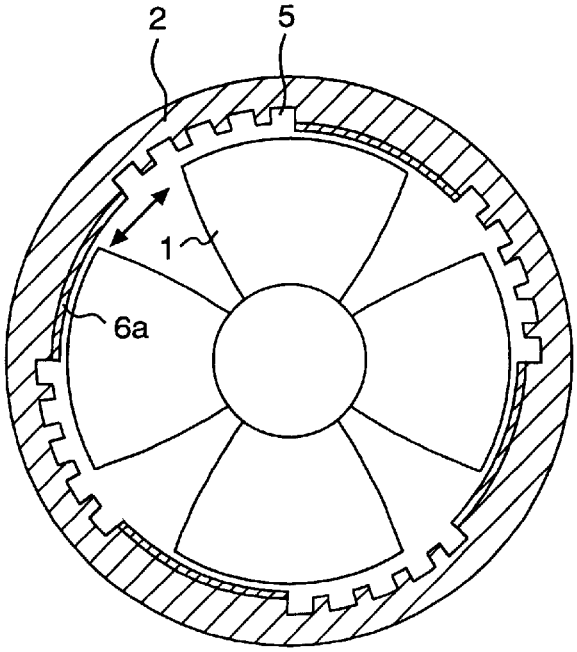
Figure 12:
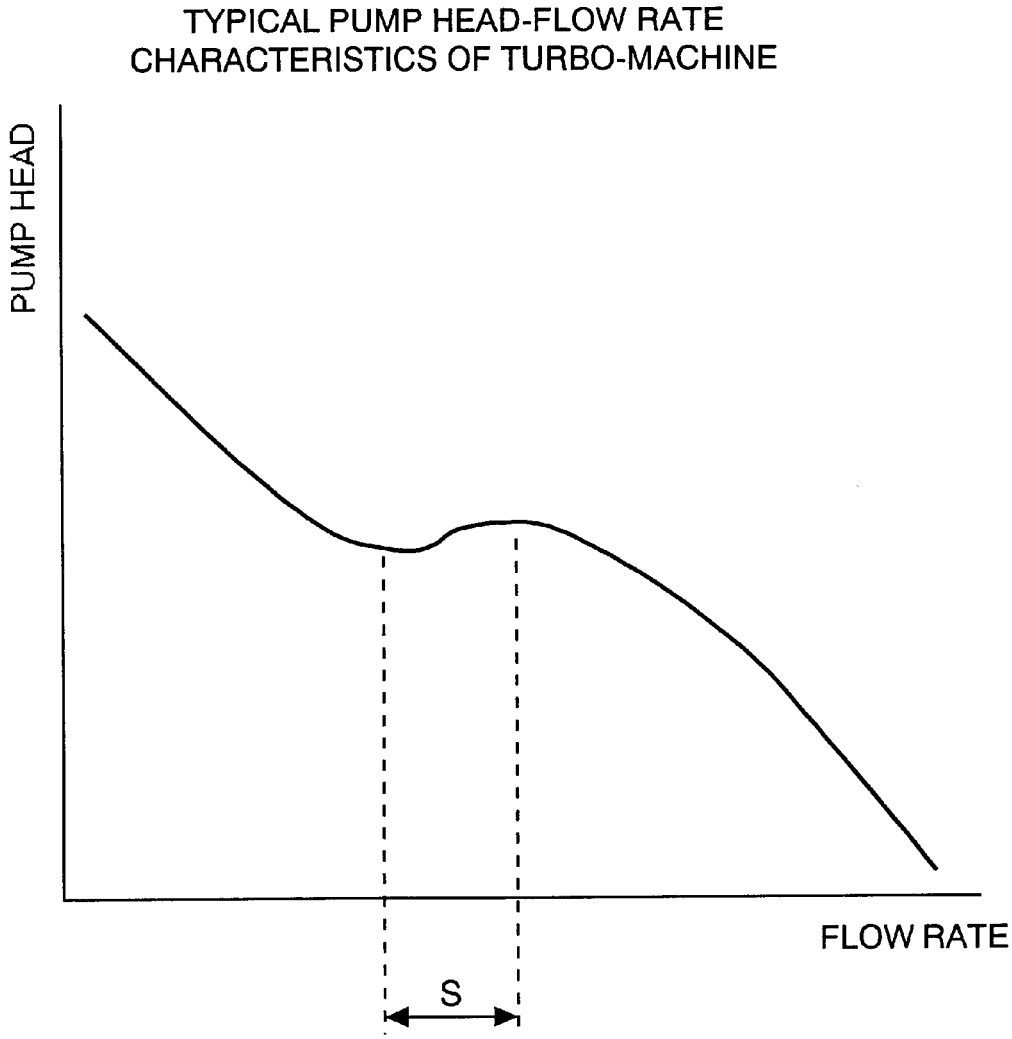
FIG. 12 is a graph for showing a typical pump head-flow rate characteristic curve of the axial-flow type hydraulic machine of the conventional art.

In the embodiment shown in FIGS. 11(*a*) and 11(*b*), a plural number of grooves 5 are formed on the inner surface of the casing 2, directing in the pressure gradient direction and aligning in the peripheral direction thereof, for connecting the impeller inlet side and an inside to within the blade residing region of the casing inner surface in. In this example, as shown in the figure, on the periphery of the casing are disposed the grooves, in a plural number of sets thereof (i.e., four (4) sets in the figure), equally, by a unit of plural pieces thereof (i.e., five (5) pieces in the figure). Also, on the inner surface of the casing 2, a comb-like cylindrical movable member 6*a* is provided to be rotatable within the casing, so that it can cover the plural sets of groups of the grooves mentioned above. Rotation of the movable member 6*a* can bring about the condition that the grooves 5 are covered with the comb-like portion of the cylindrical movable member, or alternatively, rotating movement of the comb-like portion into a portion where no grooves 5 lies can make the grooves appearing on the casing inner surface.

In this manner, in the unstable operation region where the right-uprising property appears, rotation of the movable member 6*a*, as shown in FIG. 11(*b*), brings the grooves 5 to appear on the inner surface of the casing, thereby enabling an operation with utilizing the effects of grooves, in the similar manner as in the each example mentioned above. Also, in the stable operation region, as shown in FIG. 11(*a*), rotation of the movable member 6*a* can bring the grooves 5 to be covered therewith; i.e., the condition that no groove lies therein, thereby enabling the operation with efficiency increased.

However, although the explanation was given on the example wherein the grooves 5 are provided by sets thereof, in FIGS. 11(*a*) and 11(*b*) mentioned above, it is also possible to provide the grooves 5 in a plural number, equally, aligning in the peripheral direction thereof, and also to construct the comb-like portion, so that it can cover the each groove by a pitch, being same to that of the grooves around the periphery.

According to the present invention, a portion of liquid, which is increased in pressure by the impeller, flows back in the flow passages formed in the casing, and spouts out at the position where the re-circulation flow occurs, because of provision of the grooves formed on the casing inner surface, directed in the pressure gradient direction for connecting between the impeller inlet side and an inside of the blade residing region, thereby suppressing the generation of pre-swirl in the fluid flowing into the impeller. With this, since it is possible to suppress or prevent the generation of revolution or swirl due to the re-circulating flow in the impeller blade inlet, and the generation of rotation stall of the impeller, as well, therefore, an axial-flow type hydraulic machine can be obtained, which has the pump head-flow rate characteristic curve, being improved on the right-uprising property, as well as, being suppressed in the decrease in efficiency, thereby achieving an enlargement of the operation range thereof.

Also, with provision of the grooves mentioned above, it is also possible to suppress the generation of cavitations in the side of operation with small flow rate, thereby improving the decrease in the performances thereof.

Further, with such the structure that the grooves can moved in the position and the grooves can be open or closed depending upon the operation condition of the fluid machine, it is possible to change the length of the interference caused between the grooves and the impeller, or to causes no interference therebetween; therefore, in the stable operation region in the vicinity of the design point where no right-uprising property appear, it is possible to obtain an operation condition, under which the vibrations/noises are small and the efficiency comes to be more preferable.

While we have shown and described several embodiments in accordance with our invention, it should be understood that the disclosed embodiments are susceptible of changes and modifications without departing from the scope of the invention. Therefore, we do not intend to be bound by the details shown and described herein but intend to cover all such changes and modifications falling within the ambit of the appended claims.

What is claimed is:

1. An axial-flow type hydraulic machine, comprising:

a casing, in which an axial flow impeller having a plural number of blades is disposed in a freely rotatable manner;

a casing liner being provided on an inner surface of said casing in an axial direction, in a freely rotatable manner; and a plural number of flow passages being formed on the inner surface of said casing liner aligning in peripheral direction thereof, for connecting between an inlet side of said impeller and an inside of blade residing region in a pressure gradient direction, wherein said casing liner is movable in the axial direction, so as to changing said flow passages in position thereof, to vary an interference length defined between said impeller, whereby making flow rate of fluid flowing in said flow passages into the pressure gradient direction being adjustable.

2. An axial-flow type hydraulic machine, comprising:

a casing, in which an axial flow impeller having a plural number of blades is disposed in a freely rotatable manner;

a plural number of grooves in pressure gradient direction, being formed on the inner surface of said casing aligning in a peripheral direction thereof, for connecting between an inlet side of said impeller and an inside of blade residing region on the inner surface of said casing; and a movable member being movable in an axial direction on the inner surface of said casing, whereby all or a part of said grooves in a portion opposing to the impeller blades are constructed to be able to open/or close.

3. An axial-flow type hydraulic machine, as defined in the claim 2, wherein said movable member is structured to be cylindrical in a shape thereof, and being so constructed that moving of said movable member to a discharge side brings about a condition of the grooves open in a portion opposing to said impeller blades.

4. An axial-flow type hydraulic machine, as defined in the claim 2, wherein said movable member is structured to be cylindrical in a shape thereof, and so constructed that moving of said movable member to a suction side brings about a condition of the grooves being open in a portion opposing to said impeller blades.

5. An axial-flow type hydraulic machine, as defined in the claim 4, wherein an interference length defined between the grooves and the impeller blades can vary depending upon position of said movable member, thereby making flow rate of fluid flowing in said flow passages in the pressure gradient direction being adjustable.

6. An axial-flow type hydraulic machine, comprising:

a casing, in which an axial flow impeller having a plural number of blades is disposed in a freely rotatable manner; wherein, a portion of said casing opposing to the impeller is structured to be movable in an axial direction; and a plural number of grooves in an axial direction, being formed on an inner surface of said casing aligning in a peripheral direction thereof, for connecting between an inlet side of said impeller and an inside of blade residing region in a fluid pressure gradient direction, wherein movement of said casing into the axial direction changes said grooves in position thereof varies an interference length defined between said impeller, whereby making flow rate of fluid flowing in said flow passages in the pressure gradient direction being adjustable.

7. An axial-flow type hydraulic machine, as defined in the claim 6, wherein other casing is disposed to overlap with a portion where the grooves of said movable casing, whereby to close the grooves, and being constructed, so that movement of said movable casing in the axial direction brings the grooves to appear in the blade residing region.

8. An axial-flow type hydraulic machine, as defined in the claim 7, further comprising grooves communicating in a peripheral direction, which are communicated with said grooves in the axial direction and are provided in a downstream side in a main flow direction, and wherein movement of said movable casing into the axial direction brings the grooves communicating with, in the peripheral direction, to appear in the blade residing region.

9. An axial-flow type hydraulic machine, comprising:

a casing, in which an axial flow impeller having a plural number of blades is disposed in a freely rotatable manner;

a plural number of grooves in a pressure gradient direction, being provided on an inner surface of said casing aligning in a peripheral direction thereof, for connecting between an inlet side of said impeller and an inside of blade residing region on the inner surface of said casing, so as to take out fluid of pressure, which is necessary for suppressing generation of pre-swirl within main flow at an impeller inlet; and a movable member being constructed to be movable in an axial direction within said grooves, whereby being able to open/close a portion of said grooves opposing the blades.

10. An axial-flow type hydraulic machine, comprising:

a casing, in which an axial flow impeller having a plural number of blades is disposed in a freely rotatable manner;

a plural number of grooves in a pressure gradient direction, being provided on an inner surface of said casing aligning in a peripheral direction thereof, for connecting between an inlet side of said impeller and an inside of blade residing region on the inner surface of said casing; and a movable member being constructed to be move within said grooves, whereby being able to open/close said grooves.

11. An axial-flow type hydraulic machine, as defined in the claim 10, wherein said movable member is constructed to move in a radial direction, and is able to change depth of said grooves depending upon an amount of movement thereof, whereby enabling adjustment on an amount of fluid flowing within said grooves.

12. An axial-flow type hydraulic machine, as defined in the claim 10, wherein said movable member is provided to be rotatable around a fulcrum at one end thereof, and is able to change depth of said grooves depending upon an amount of rotational movement thereof, whereby enabling adjustment on an amount of fluid flowing within said grooves.

13. An axial-flow type hydraulic machine, comprising:

a casing, in which an axial flow impeller having a plural number of blades is disposed in a freely rotatable manner;

a plural number of grooves formed into pressure gradient direction, being provided on an inner surface of said casing aligning in a peripheral direction thereof, for connecting between an inlet side of said impeller and an inside of blade residing region on the inner surface of said casing; and a movable member being constructed to be move on an inner surface of said casing in peripheral direction, whereby being able to open/close said grooves.

14. An axial-flow type hydraulic machine, as defined in the claim 13, wherein each of the grooves formed in said pressure gradient direction has width being equal or greater than 5 mm and depth being equal or greater than 2 mm, and further the width of the groove is greater than the depth thereof.

15. An axial-flow type hydraulic machine, as defined in the claim 13, wherein the grooves formed in said pressure gradient direction are structured, so that total width thereof occupies about 30–50% to a periphery length of the inner surface of said casing where said grooves reside therein, while the depth thereof is about 0.5–2% of a diameter of the inner surface of said casing where said grooves reside therein and about 10–30% of the width of said groove, and further each the groove is constructed, so that it is about 20–50% of length of the blade in a portion thereof opposing to the blades.

* * * * *